US007210482B2

(12) United States Patent
Huang et al.

(10) Patent No.: US 7,210,482 B2
(45) Date of Patent: May 1, 2007

(54) FACE MASK STRUCTURE

(75) Inventors: Po-Hsiung Huang, Taipei (TW); Cheng-Kun Chu, Tucheng (TW); Hung-En Chen, Taipei (TW); Jing-Tyr Lin, Taoyuan County (TW); Jen-Hsiung Lee, Banciao (TW)

(73) Assignees: Taiwan Textile Research Institute, Taipei Country (TW); Champak Enterprise Co., Ltd., Taoyuan County (TW)

( * ) Notice: Subject to any disclaimer, the term of this patent is extended or adjusted under 35 U.S.C. 154(b) by 0 days.

(21) Appl. No.: 11/296,214

(22) Filed: Dec. 8, 2005

(65) Prior Publication Data

US 2007/0023046 A1 Feb. 1, 2007

(30) Foreign Application Priority Data

Jul. 29, 2005 (TW) ..... 94125910 A

(51) Int. Cl.
*A62B 7/10* (2006.01)
*A62B 18/02* (2006.01)
*A41D 13/00* (2006.01)

(52) U.S. Cl. ..... 128/206.12; 128/206.19; 128/206.21; 128/205.25; 128/206.13; 2/9

(58) Field of Classification Search ..... 128/205.25, 128/205.29, 206.12, 206.13, 206.16, 206.19, 128/206.21; 2/9, 206
See application file for complete search history.

(56) References Cited

U.S. PATENT DOCUMENTS

| | | | | |
|---|---|---|---|---|
| 4,248,220 | A * | 2/1981 | White | 128/206.19 |
| 4,419,994 | A * | 12/1983 | Hilton | 128/206.19 |
| 4,941,470 | A * | 7/1990 | Hubbard et al. | 128/206.13 |
| 5,699,791 | A * | 12/1997 | Sukiennik et al. | 128/206.13 |
| 5,927,280 | A * | 7/1999 | Miyake | 128/857 |
| 6,062,220 | A * | 5/2000 | Whitaker et al. | 128/206.19 |
| 6,123,077 | A * | 9/2000 | Bostock et al. | 128/206.12 |
| 6,427,693 | B1 * | 8/2002 | Blackstock et al. | 128/205.27 |
| 6,536,434 | B1 * | 3/2003 | Bostock et al. | 128/206.12 |
| 2003/0226563 | A1 * | 12/2003 | Brunell et al. | 128/205.27 |
| 2004/0255946 | A1 * | 12/2004 | Gerson et al. | 128/205.27 |
| 2006/0130842 | A1 * | 6/2006 | Kleman | 128/206.19 |

* cited by examiner

*Primary Examiner*—Justine R. Yu
*Assistant Examiner*—Amadeus Lopez
(74) *Attorney, Agent, or Firm*—Rosenberg, Klein & Lee

(57) ABSTRACT

A face mask structure has an upper mask portion, a middle mask portion, and a lower mask portion, which are formed integrally. The upper mask portion has an upper metal stripe disposed at a proper position thereof. The lower mask portion has a lower metal stripe disposed at a proper position thereof. The upper and lower mask portions are folded in opposite directions. When in use, the upper and lower mask portions are spread out to support the middle mask portion. In this way, the face mask structure becomes fitting in with the shapes of human faces. Furthermore, the middle mask portion has multiple folding portions. When in use, the folding portions are stretched out to increase filtering area. Thereby, the inner space of the face mask structure is increased, the air-invasion rate is reduced, and the filtering efficiency is thus improved.

10 Claims, 9 Drawing Sheets

FACE MASK STRUCTURE

BACKGROUND OF THE INVENTION

1. Field of the Invention

The present invention is related to a face mask structure, and more particularly, to a gauze structure that has an upper mask portion, a middle mask portion, and a lower mask portion that are formed integrally. The middle mask portion has multiple folding portions. The folding portions of the middle mask can be stretched to increase the filtration area.

2. Description of Related Art

After face mask structures were invented, the face mask structures that are seen commonly can be divided into two categories according to their shapes, i.e. flat type face mask structures and half-face face mask structures. In addition, according to applications, face mask structures can also be divided into two categories, i.e. face mask structures for filtering particulate and face mask structures for filtering air. The face mask structures for filtering air need to be provided with porous materials, such as activated carbon. According to the properties of the porous materials, different kinds of noxious gases or organic gases can be absorbed.

However, like safety helmets, face mask structures are effective only when they are used correctly. When people select or use the face mask structures, they should not only consider the filtering functions of the face mask structures but also the airtight property of the face mask structures. If the airtight property of the face mask structures is not good enough, people will still breathe in noxious air via chinks when they wear the face mask structures. Thus, face mask structures cannot protect people from breathing noxious air even though their filtering functions are perfect.

Reference is made to FIG. 1, which is a schematic diagram of a conventional flat type face mask structure. As shown in FIG. 1, the flat type face mask structure has a mask body 1' and two cords. The mask body 1' includes a nonwoven cloth 10' and a metal stripe 11'. Since the original area of the mask body 1' is too small to sufficiently cover user's nose and mouth, the mask body 1' further has multiple folding portions 12'. When the face mask structure is used, the folding portions 12' of the mask body 1' need to be stretched out so that the mask body 1' can completely cover user's nose and mouth. Hence, except for enlarging the area of the mask body 1', the folding portions 12' do not have other functions.

When the flat type face mask structure is worn, the metal stripe 11' can be used to make the upper end of the face mask structure fit in with the shape of user's nose. Hence, the invasion of noxious gas via the upper end of the face mask structure can be prevented effectively. However, there is no metal stripe or other structures disposed at the lower end of the face mask structure to prevent the invasion of noxious gas. Hence, people may still breathe in noxious gas when they wear this kind of face mask structure.

Reference is made to FIG. 2, which is a schematic diagram of a conventional breath protection device disclosed in U.S. Pat. No. 6,123,077. As shown in FIG. 2, the breath protection device 2' includes a mask body 21', a first component 22', a second component 23', and two straps. Therein, the breath protection device 2' can be formed integrally. It means that the first component 22' and the second component 23' can be formed by folding the mask body 21' along the joint lines 24', 25'. Of course the breath protection device 2' can also be provided via combination. It means that the first component 22' and the second component 23' can be adhered or attached to the mask body 21' to provided the breath protection device 2'.

When the breath protection device 2' is in use, the first component 22' and the second component 23' need to be spread out to make the breath protection device 2' have a cup shape. In addition, by using the straps, the breath protection device 2' can be fixed at a specific position of a user's face.

However, although the breath protection device 2' can be made integrally to lower the cost, it still has some drawbacks. Since the breath protection device 2' needs to cover a user's face for a long time when in use and the mask body 21' does not have a structure for enlargement of inner space, the breath protection device 2' usually makes people who wear it breathe hard. Moreover, since the breath protection device 2' rises high and erect when in use, it is easy to sink or be twisted due to external force. Hence, the breath protection device 2' is easily damaged.

Therefore, how to provide a face mask structure to resolve the drawbacks of the prior art has been desired for a long time. Accordingly, in view of the research, development and practical sale experiences of the related products for many years, the inventor of the present invention sought to improve the prior art. Via inventor's professional knowledge and his research, design and case study in many ways, the inventor finally proposes a novel face mask structure to resolve the drawback mentioned above.

SUMMARY OF THE INVENTION

An objective of the present invention is to provide a face mask structure. In the present invention, the upper portion, the middle portion, and the lower portion of the face mask structure are formed integrally. A sewing procedure for attaching the upper portion and the lower portion to the middle portion is unnecessary. Hence, the present invention lowers the consumption of materials and reduces the labor cost. Moreover, the middle mask portion has multiple folding portions. Stretching out the folding portions can increase the filtration area of the middle mask portion. In this way, the inner space of the face mask structure for user's breathing is increased, the air-invasion rate is reduced, and the feeling of oppression is mitigated.

Another objective of the present invention is to provide a face mask structure. Both of the upper mask portion and the lower mask portion of the face mask structure have a metal stripe located at a proper position thereof. The upper mask portion and the lower mask portion are folding in opposite directions. When in use the upper mask portion and the lower mask portion are spread out to support the middle mask portion to form a polyhedron. The polyhedron design fits in with the shapes of human faces, increases the inner space of the face mask structure, lowers air-invasion rate, and effectively improves filtering efficiency. Hence, the face mask structure of the present invention can be used in an environment with heavy pollution.

Still another objective of the present invention is to provide a face mask structure. The upper mask portion and the lower mask portion of the face mask structure are folded in the opposite direction to form a plane folding structure so as to prevent the face mask structure from being contaminated by contact when the face mask structure is taken off.

Still another objective of the present invention is to provide a face mask structure. The face mask structure has two ropes. Therein, the two ropes are formed with a line shape, a stripe shape, or a plate shape for a user to hang on his ears or head or tie on his head. Due to the design of the ropes, the feeling of oppression is mitigated effectively and the variety and competitiveness of the present invention is improved.

For achieving the objectives above, the present invention provides a face mask structure. The face mask structure has an upper mask portion, a middle mask portion, and a lower mask portion. The upper mask portion, the middle mask portion, and the lower mask portion of the face mask structure are formed integrally. The upper mask portion has an upper metal stripe disposed at a proper position thereof. The middle mask portion has a plurality of folding portions. The lower mask portion has a lower metal stripe disposed at a proper position thereof.

The upper mask portion and the lower mask portion are folded in opposite directions. When in use, the upper mask portion and the lower mask portion are spread out to prop up the middle mask portion. In this way, the face mask structure of the present invention becomes fitting in with the shapes of human faces. Furthermore, when the face mask structure is in use, the folding portions are stretched out to increase filtering area of the middle mask portion. In this way, the filtration area of the middle mask portion is increased and the filtering efficiency is thus improved. Hence, the face mask structure of the present invention is suitable to be used in an environment with heavy pollution. Stretching out the folding portions of the middle mask portion can further increase the inner space of the face mask structure, reduce the air-invasion rate, and mitigate the feeling of oppression.

Furthermore, since the upper mask portion and the lower mask portion are folded in the opposite direction, the face mask structure can be prevented from being contaminated by contact when the face mask structure is taken off. Moreover, the ropes can be designed variously. Hence, the diversity of the present invention is improved.

The above summaries are intended to illustrate exemplary embodiments of the invention, which will be best understood in conjunction with the detailed description to follow, and are not intended to limit the scope of the appended claims.

BRIEF DESCRIPTION OF THE DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings, in which:

DETAILED DESCRIPTION OF PREFERRED EMBODIMENTS

The present invention provides a face mask structure. The face mask structure of the present invention has an upper portion, a middle portion, and a lower portion. Therein, the upper portion, the middle portion, and the lower portion are formed integrally. The upper portion, the middle portion, and the lower portion are provided by folding and thereby form a plane folding structure. Unlike the prior art, which needs to attach an upper mask body and a lower mask body respectively to the upper end and the lower end of the middle mask body by sewing or adhesion, the present invention is formed integrally. Hence, the present invention improves the production efficiency, lowers the consumption of materials, and reduces the labor cost.

In addition, the middle portion of the face mask structure of the present invention further has multiple folding portions. Different from the prior art, which provides the folding portions only for forming a face mask structure that can completely cover a user's nose and mouth, the present invention provides the folding portions to increase the inner space and enlarge the filtration area. The folding portions of the present invention can not only make the face mask structure more air-permeable but also make it easier for the user to breathe.

Figure 1:
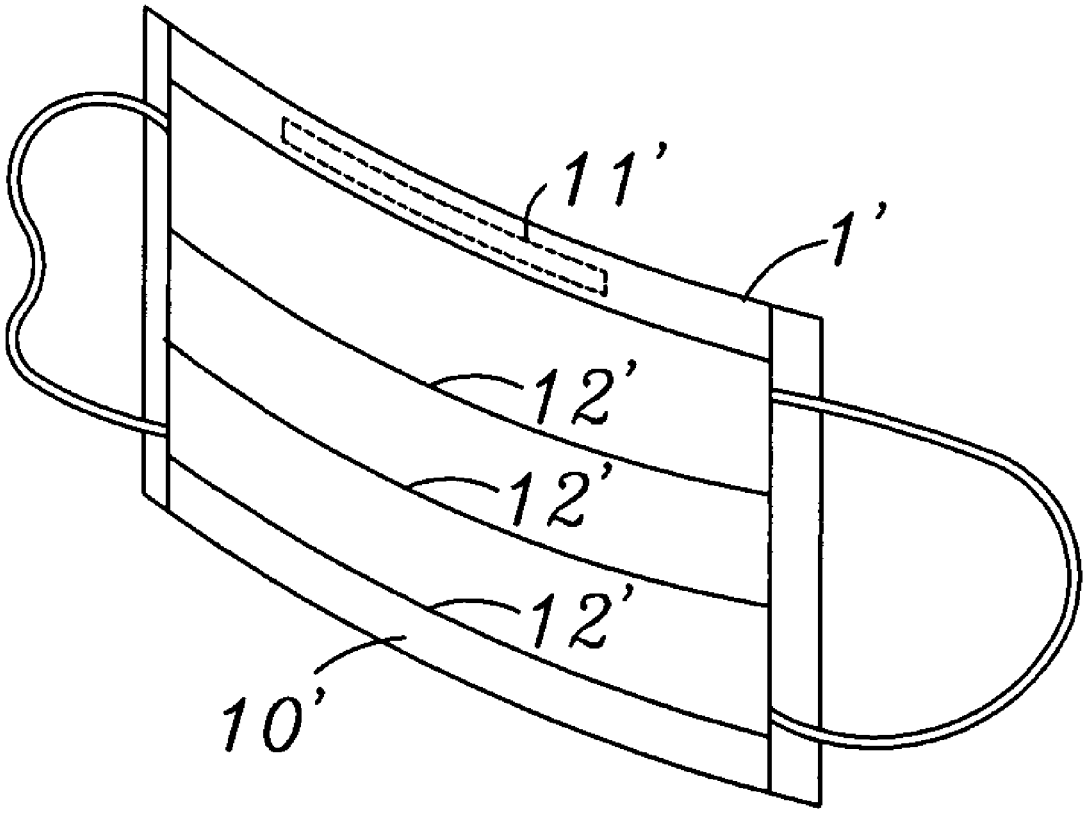
Fig. 1 (Prior Art)
FIG. 1 is a schematic diagram of a conventional flat type face mask structure.
Figure 2:
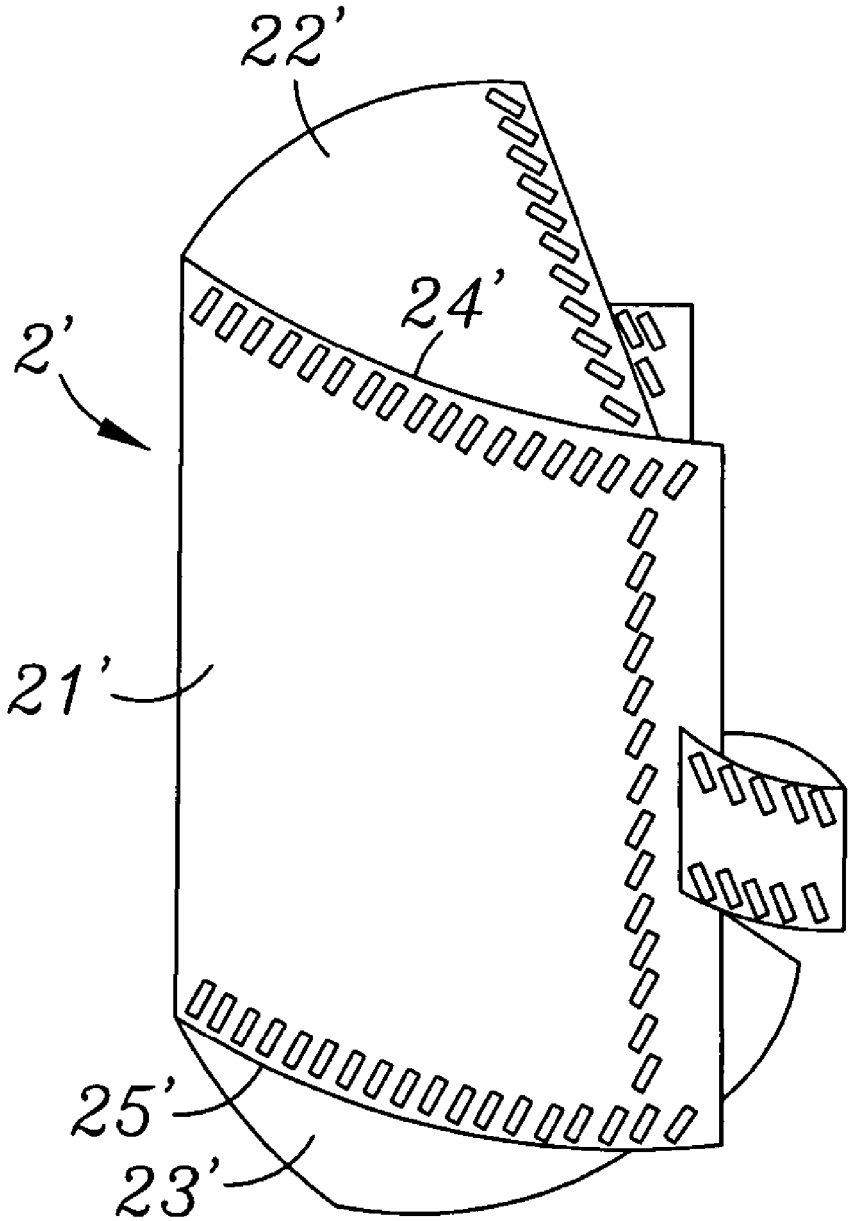
Fig. 2 (Prior Art)
FIG. 2 is schematic diagram of a conventional breath protection device.
Figure 3:
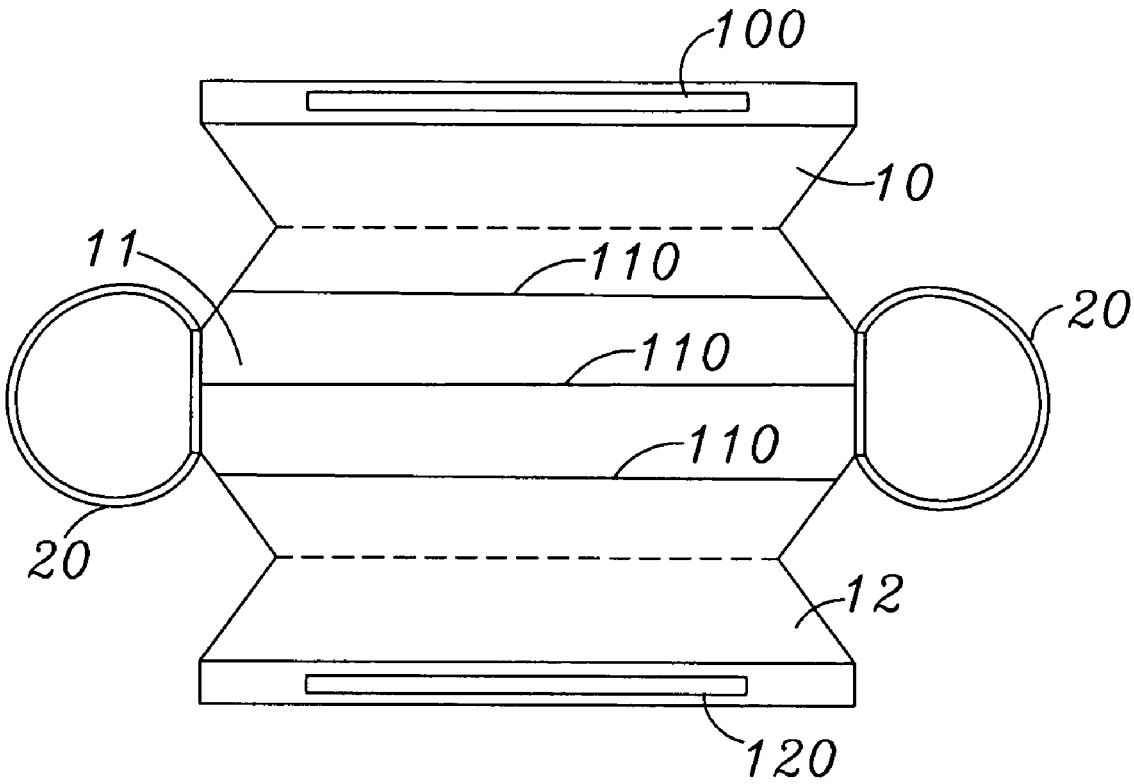
FIG. 3 is a schematic diagram of a face mask structure in accordance with a preferred embodiment of the present invention.

First, reference is made to FIG. 3, which is a schematic diagram of a face mask structure in accordance with a preferred embodiment of the present invention. The face mask structure of the present invention has an upper mask portion 10, a middle mask portion 11, and a lower mask portion 12. The upper mask portion 10 is located above the middle mask portion 11. The middle mask portion 11 is located above the lower mask portion 12. Therein, the upper mask portion 10, the middle mask portion 11, and the lower mask portion 12 are formed integrally. Hence, the step of attaching the upper mask portion 10 and the lower mask portion 12 to the upper end and the lower end of the middle mask portion 11 is prevented.

Therein, the upper mask portion 10 includes a metal stripe 100. The metal stripe 100 is located at upper end of the upper mask portion 10. The middle mask portion 11 has multiple folding portions 110. Moreover, the face mask structure of the present invention further has two ropes 20. The two ropes 20 are formed with a line shape, a stripe shape, or a plate shape for a user to hang on his ears or head or tie on his head. The two ropes 20 are disposed at the two sides of the middle mask portion 11. The lower mask portion 12 also has a metal stripe 120. The metal stripe 120 is located at a lower end of the lower mask portion 12.

Figure 4A:
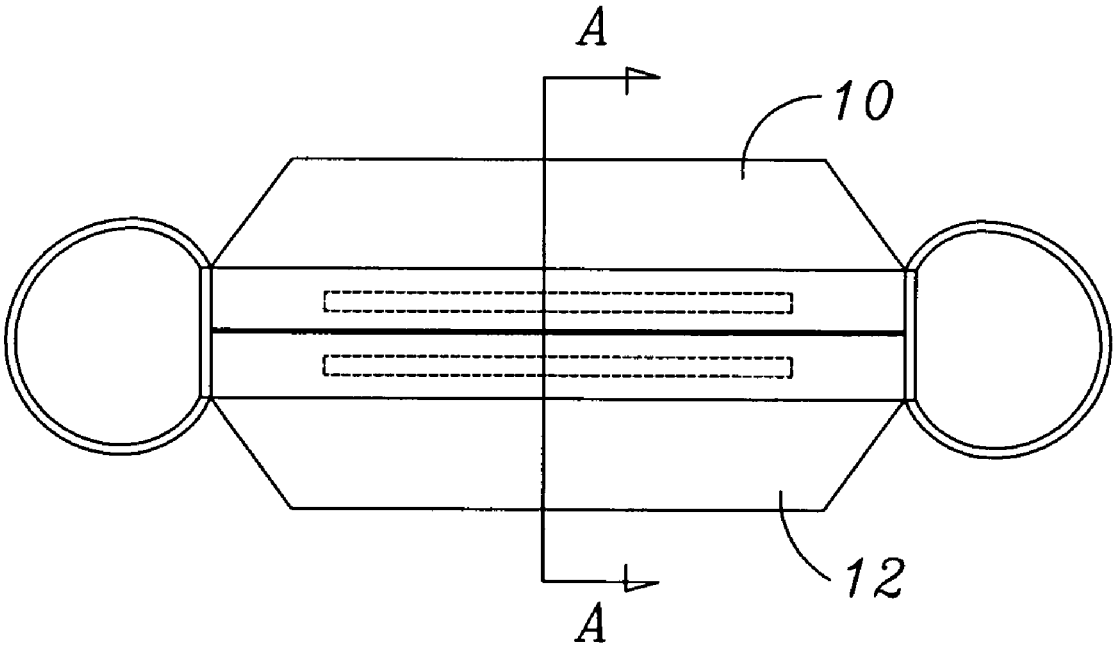
FIG. 4A is a rear view of a face mask structure in accordance with a preferred embodiment of the present invention.
Figure 4B:
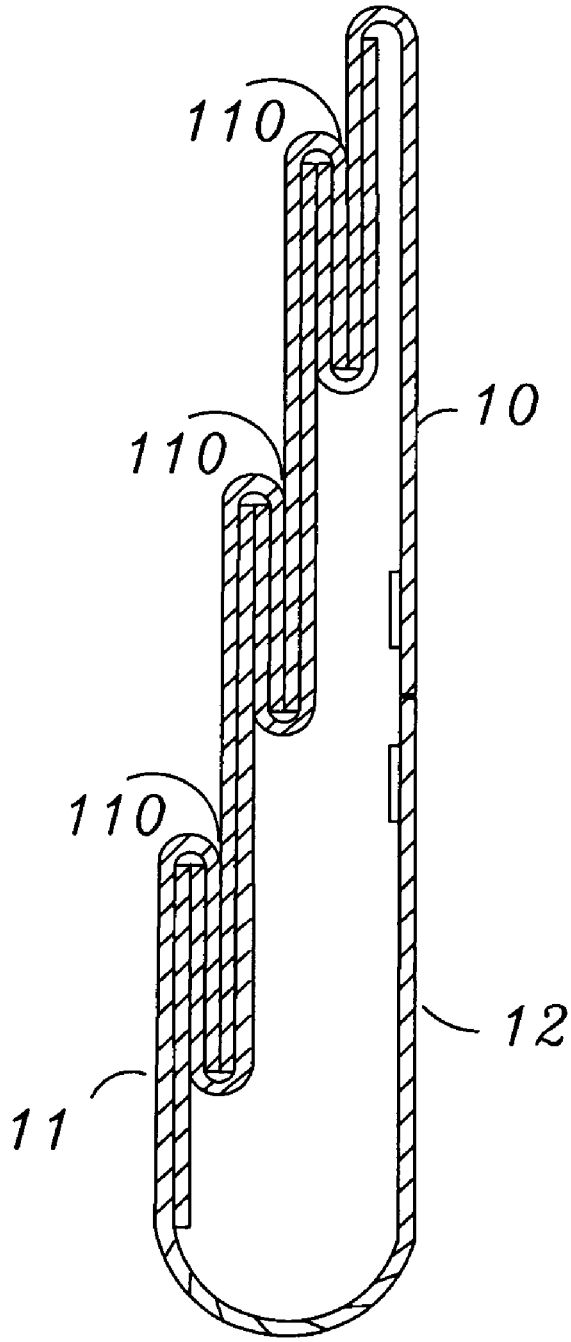
FIG. 4B is a cross-sectional view of the face mask structure along the A—A line shown in FIG. 4A.
Figure 4C:
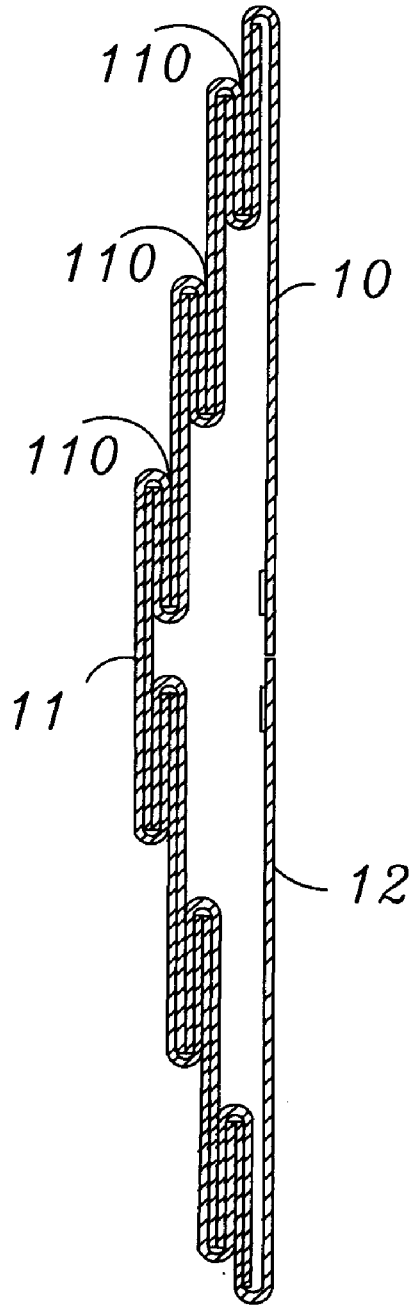
FIG. 4C is a cross-sectional view showing another structure of the folding portions of the face mask structure shown in FIG. 4A.

Reference is made to FIGS. 4A, 4B, and 4C. As shown in these figures, the upper mask portion 10 and the lower mask portion 12 both have two sides formed with bevel angles and thus form a trapezoid shape. The upper mask portion 10 and the lower mask portion 12 are folded in opposite directions, i.e. in the direction of the middle mask portion 11, to form a plate folding structure. Both of the upper mask portion 10 and the lower mask portion 12 have a width equal to or larger than a half of the width of the middle mask portion 11. Moreover, the folding portions 110 of the middle mask portion 11 can be formed asymmetrically as shown in FIG. 4B or symmetrically as shown in FIG. 4C. When the folding portions 110 of the middle mask portion 11 are formed symmetrically, the number of the folding portion 110 is even.

In addition, reference is made to Table 1 and Table 2, which show some experiment results for the nonwoven face mask structure with activated carbon and the nonwoven face mask structure without activated carbon in accordance with the present invention. In this embodiment, the comparison is made between the nonwoven face mask structure with three folding portions and the nonwoven face mask structure without folding portions. As shown in these tables, the analysis of the present invention is made by using TSI3160, i.e. the fractional efficiency filter taster. According to the analytical results, compared with the nonwoven face mask structure with activated carbon that has no folding portions, the filtering efficiency of the nonwoven face mask structure with activated carbon that has three folding portions increases 6.0% and the ratio of being crashed by external force is reduced 37.6%. Compared with the nonwoven face mask structure without activated carbon that has no folding portions, the filtering efficiency of the nonwoven face mask structure without activated carbon that has three folding portions increases 6.1% and the ratio of being crashed by external force is reduced 44.1%.

TABLE 1

Experiment results for nonwoven face mask structure with activated carbon.

| Items | Nonwoven face mask structure with activated carbon that has no folding portions | Nonwoven face mask structure with activated carbon that has three folding portions |
|---|---|---|
| Filtration efficiency (%) | 78% | 83% |
| Pressure difference ($mmH_2O$) | 6.9 | 4.3 |

TABLE 2

Experiment results for nonwoven face mask structure without activated carbon.

| Items | Nonwoven face mask structure having no folding portions | Nonwoven face mask structure having three folding portions |
|---|---|---|
| Filtration efficiency (%) | 77% | 82% |
| Pressure difference ($mmH_2O$) | 6.8 | 3.8 |

Figure 5:
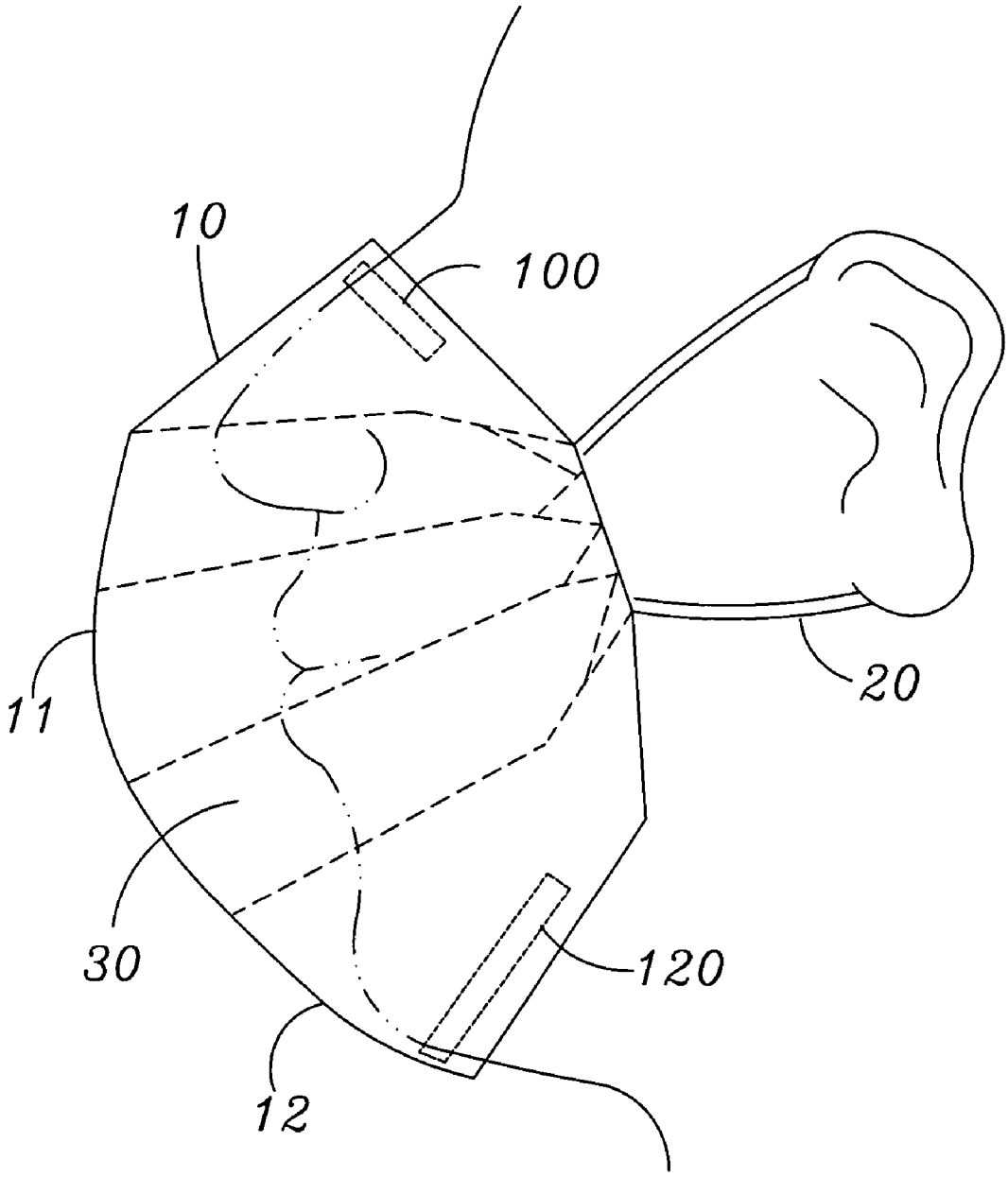
FIG. 5 shows a schematic diagram of the face mask structure that is in use in accordance with the present invention.

Reference is made to FIG. 5, which is a schematic diagram of another face mask structure in accordance to a preferred embodiment of the present invention. Therein, the upper mask portion 10, the middle mask portion 11, and the lower mask portion 12 are formed integrally. The upper mask portion 10 and the lower mask portion 12 both have two sides formed with bevel angles and thus form a trapezoid shape. The upper mask portion 10 and the lower mask portion 12 are folded in the direction of the middle mask portion 11. When in use, the upper mask portion 10 and the lower mask portion 12 are spread out to support the middle mask portion 11 to form a polyhedron. When the upper mask portion 10 and the lower mask portion 12 are spread out, the metal stripe 100 of the upper mask portion 10 is tightly pressed to two sides of user's nose and the distance between the two sides of the nose and the middle mask portion 11 is increased. Moreover, when the upper mask portion 10 and the lower mask portion 12 are spread out, the metal stripe 120 of the lower mask portion 12 is tightly pressed to two sides of user's chin and the distance between the two sides of the chin and the middle mask portion 11 is increased. The polyhedron design of the present invention can reduce the probability of movement of the face mask structure that is caused due to the movement of user's face.

In addition, when in use, the multiple folding portions 110 of the middle mask portion 11 are stretched out to increase the inner space 30 so that the distance between user's face and the middle mask portion 11 is increased. In this way, the space for breath is increased and the filtering efficiency is improved. Hence, one can breathe easily when he wears the face mask structure and the feeling of oppression is reduced. Furthermore, the two ropes can be designed for a user to hang on his ears or head or tie on his head. Hence, the wearing quality or diversity is improved.

Figure 6A:
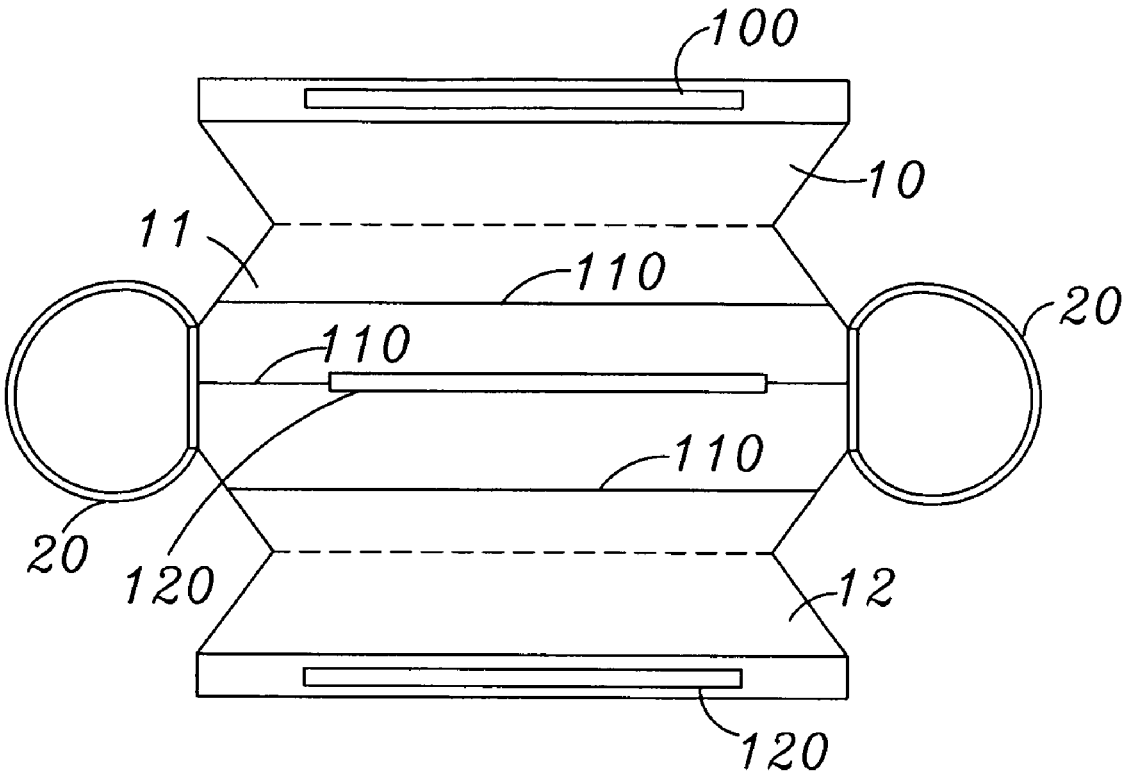
FIG. 6A is a schematic diagram of a face mask structure with a middle metal stripe in accordance with a preferred embodiment of the present invention.
Figure 6B:
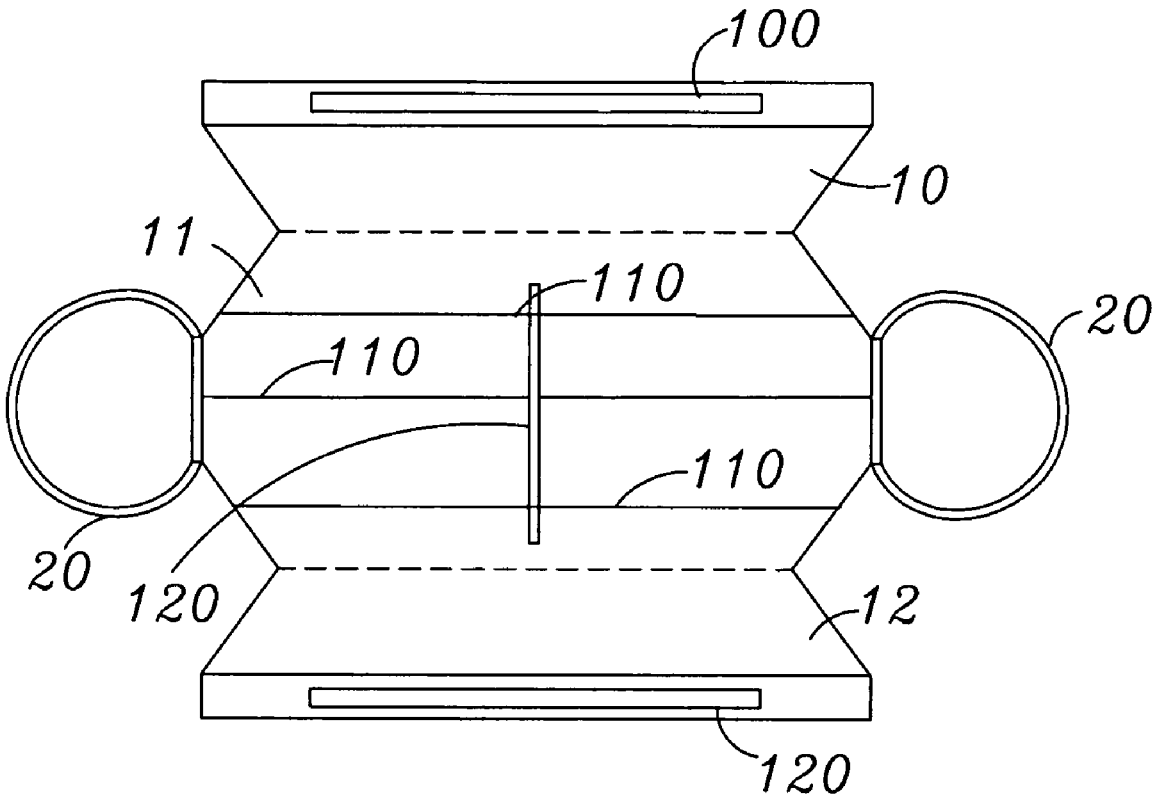
FIG. 6B is a schematic diagram of a face mask structure with a middle metal stripe in accordance with another preferred embodiment of the present invention.

Finally, reference is made to FIGS. 6A and 6B, which shows two face mask structures whose middle mask portions have metal stripes in accordance to the present invention. As shown in these figures, for different applications, the face mask structure of the present invention can be made of different materials. In other words, due to different requirements, the weights of the filtering materials for making the face mask structures are different. Hence, in the present invention, the middle mask portion 11 can further include a metal stripe 120. The metal stripe 120 is disposed at a proper position of the middle mask portion 11.

As shown in FIGS. 6A and 6B, the metal stripes 120 of the middle mask portions 11 of these two embodiments are disposed externally and can be arranged vertically or horizontally. The metal stripes 120 of these two embodiments are both used for supporting the middle mask portion 11. In this way, the middle mask portion 11 can be prevented from sinking due to its weight. Furthermore, by using the metal stripes 120, the shape of the middle mask portion 11 can be modified according to user's requirements or habits.

To sum up, the present invention provides a face mask structure. Since the face mask structure of the present invention is formed integrally, the production rate is increased, the consumption of materials is reduced, and the labor cost is lowered. In addition, the plane folding design of the present invention can prevent the face mask structure from being contaminated by contact when the face mask structure is taken off. Furthermore, since the middle mask portion has multiple folding portions, one can easily breathe when wearing the face mask structure, the air-invasion rate is reduced, and the feeling of oppression is mitigated. Moreover, the ropes can be designed variously. Hence, the diversity of the present invention is improved.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are embraced within the scope of the invention as defined in the appended claims.

What claimed is:

1. A face mask structure, comprising:

an upper mask portion having beveled angles on opposing outer sides thereof to form a trapezoidal upper portion of the face mask structure and has a metal stripe disposed at an upper position thereof;

a middle mask portion that is located below the upper mask portion to form a middle portion of the face mask structure, the middle portion having a plurality of folding portions; and a lower mask portion having beveled angles on opposing outer sides thereof to form a trapezoidal lower portion of the face mask structure and is located below the middle mask portion;

wherein the upper mask portion, the middle mask portion, and the lower mask portion are formed integrally in single piece formation, the upper mask portion and the lower mask portion being wider than a half of the width of the middle mask portion, the upper mask portion and the lower mask portion being folded in opposite directions over the middle portion when the mask is not in use, the upper mask portion and the lower mask portion are unfolded away from the middle mask portion when in use so that the metal stripe is located at a user's nose, the folding portions being stretched out to increase a filtering area of the middle mask portion when the face mask structure is in use.

2. The face mask structure as claimed in claim 1, wherein the middle mask portion is made of a material composed of fibers or a fibrous composite.

3. The face mask structure as claimed in claim 1, wherein the spreading out of the folding portions of the middle mask portion increases inner space of the face mask structure.

4. The face mask structure as claimed in claim 1, further comprising two ropes.

5. The face mask structure as claimed in claim 4, wherein the ropes are formed with a line shape, a stripe shape, or a plate shape for a user to hang on his ears or head or tie on his head.

6. The face mask structure as claimed in claim 1, wherein the middle mask portion further comprises a middle metal stripe, the middle metal stripe is located at a central position of the middle mask portion and used to support the middle mask portion.

7. The face mask structure as claimed in claim 6, wherein the middle metal stripe is disposed vertically or horizontally at the central position of the middle mask portion.

8. The face mask structure as claimed in claim 1, wherein the lower mask portion further comprises a lower metal stripe, and the lower metal stripe is located at a lower position of the lower mask portion.

9. The face mask structure as claimed in claim 1, wherein the folding portions are formed symmetrically.

10. The face mask structure as claimed in claim 1, wherein the folding portions are formed asymmetrically.

* * * * *